US006970059B2

(12) United States Patent
Mueller et al.

(10) Patent No.: US 6,970,059 B2
(45) Date of Patent: Nov. 29, 2005

(54) SLOT MOTOR INCLUDING LEGS ENGAGING OPENINGS OF CIRCUIT BREAKER HOUSING AND ELECTRICAL SWITCHING APPARATUS EMPLOYING THE SAME

(75) Inventors: Robert W. Mueller, Aliquippa, PA (US); Thomas A. Whitaker, North Huntingdon, PA (US)

(73) Assignee: Eaton Corporation, Cleveland, OH (US)

( * ) Notice: Subject to any disclaimer, the term of this patent is extended or adjusted under 35 U.S.C. 154(b) by 47 days.

(21) Appl. No.: 10/733,145

(22) Filed: Dec. 11, 2003

(65) Prior Publication Data

US 2005/0128033 A1 Jun. 16, 2005

(51) Int. Cl.[7] ..... H01H 75/00

(52) U.S. Cl. ..... 335/16; 335/147; 335/202; 335/195

(58) Field of Search ..... 335/16, 147, 195, 335/202, 165–176; 218/22

(56) References Cited

U.S. PATENT DOCUMENTS 3,815,059 A 6/1974 Spoelman
4,375,021 A 2/1983 Pardini et al.
4,546,336 A 10/1985 Petrie et al.
4,546,337 A 10/1985 Petrie et al.
4,549,153 A 10/1985 Forsell et al.
4,743,720 A * 5/1988 Takeuchi et al. ..... 218/24
4,963,849 A * 10/1990 Kowalczyk et al. ..... 335/201
4,970,482 A 11/1990 Jacobs et al.
5,694,098 A * 12/1997 Mody et al. ..... 335/16
5,910,760 A 6/1999 Malingowski et al.
6,281,459 B1 * 8/2001 Munsch et al. ..... 218/22
6,452,470 B1 9/2002 Malingowski et al.

* cited by examiner

*Primary Examiner*—Lincoln Donovan
(74) *Attorney, Agent, or Firm*—Martin J. Moran

(57) ABSTRACT

A circuit breaker includes a housing having first and second openings, with stationary and movable separable contacts disposed therein. An operating mechanism is disposed in the housing, is coupled to the separable contacts and is structured to move those contacts between open and closed positions. A trip mechanism is disposed in the housing and cooperates with the operating mechanism to trip open the separable contacts. A slot motor assembly is disposed about the separable contacts and has upper and lower slot motor portions. The upper slot motor portion is disposed above the movable contact and the lower slot motor portion is disposed below the stationary contact. The upper slot motor portion includes a rigid, laminated steel member having a general U-shape, with a bight portion, and first and second legs. The first and second legs engage the housing at the respective first and second openings.

8 Claims, 7 Drawing Sheets

SLOT MOTOR INCLUDING LEGS ENGAGING OPENINGS OF CIRCUIT BREAKER HOUSING AND ELECTRICAL SWITCHING APPARATUS EMPLOYING THE SAME

BACKGROUND OF THE INVENTION

1. Field of the Invention

The present invention relates to electrical switching apparatus, such as, for example, circuit breakers and, more particularly, to circuit breakers employing a slot motor.

2. Background Information

Circuit breakers, such as molded case circuit breakers, include at least one pair of separable contacts. A first contact is fixed within the molded case housing and a second movable contact is coupled to an operating mechanism. These separable contacts are in electrical communication with either the line or the load coupled to the circuit breaker. The operating mechanism moves the movable contact between a first, open position wherein the movable contact is spaced from the fixed contact, and a second, closed position wherein the fixed and movable contacts are in contact and electrical communication. The operating mechanism may be operated manually or by a trip mechanism.

The exterior walls of molded case circuit breakers have typically been a weak link for case strength and a limiting factor in increasing the interrupting ratings of circuit breakers.

In order to enhance the speed of separation of the separable contacts, the contacts may be disposed within a slot motor, which increases interruption performance. The slot motor is a ring or loop-shaped device made of magnetically permeable material (e.g., steel), which surrounds the contacts and the movable contact arm of the circuit breaker. When the circuit is live, an electrical arc may be drawn between the electrical contacts during separation. The electrical current interacts electromagnetically with the slot motor to induce a magnetic field in the magnetic material of the slot motor, which, in turns, interacts with the separating contacts and the movable contact arm to accelerate the contact opening process. Examples of slot motors are disclosed in U.S. Pat. Nos. 4,375,021; 4,546,336; 4,546,337; 4,549,153; 4,970,482; 5,694,098, and 6,281,459.

Slot motors generally have two assemblies, an upper assembly and a lower assembly. Both upper and lower assemblies include a corresponding housing and a plurality of plates composed of the magnetically permeable material. The lower assembly is disposed below the fixed contact. As shown in FIG. 1, the upper assembly is an inverted U-shaped assembly having a housing assembly 1 and a plurality of plates 2, forming a bight portion 3 and two legs 4,5. The upper slot motor assembly is structured to be disposed over the movable contact (not shown) wherein the tips of the upper assembly legs 4,5 contact the lower slot motor assembly (not shown). The upper assembly legs 4,5 have an extended length to accommodate the path of travel of the movable contact arm (not shown). That is, the movable contact (not shown) is disposed between the upper assembly legs 4,5 and as the movable contact moves between the first, open position and the second, closed position, the movable contact moves from a position adjacent to the upper assembly bight portion 3 to a position adjacent the tips of the legs 4,5. Accordingly, the legs 4,5 have a sufficient length to accommodate the path of travel of the movable contact arm.

There is room for improvement in electrical switching apparatus, such as circuit breakers, employing a slot motor.

SUMMARY OF THE INVENTION

These needs and others are met by the present invention which employs the rigid legs of a slot motor to reinforce the exterior walls of a circuit breaker housing. In addition to increasing the strength of the circuit breaker housing, this structure reduces parts, since it eliminates a corresponding slot motor housing assembly and, instead, employs the circuit breaker housing.

As one aspect of the invention, an upper slot motor assembly for a circuit breaker slot motor assembly comprises: a circuit breaker housing including a circuit breaker base having a first opening and a second opening; and a rigid magnetic member having a bight portion, a first leg, and a second leg, the first leg of the rigid magnetic member engaging the circuit breaker base of the circuit breaker housing at the first opening, the second leg of the rigid magnetic member engaging the circuit breaker base of the circuit breaker housing at the second opening.

The rigid magnetic member may comprise a plurality of laminated U-shaped plates resting in a U-shaped holder. Each of the laminated U-shaped plates may include a bight portion, and a pair of legs. The U-shaped holder may include a bight portion engaging the bight portion of each of the laminated U-shaped plates and a pair of legs engaging the pair of legs of each of the laminated U-shaped plates.

The circuit breaker base of the circuit breaker housing may include a plurality of first interior walls and a first exterior wall, which define the first opening of the circuit breaker base, and a plurality of second interior walls and a second exterior wall, which define the second opening of the circuit breaker base. The first and second legs of the rigid magnetic member may engage the first and second interior walls, in order to reinforce the first and second exterior walls, respectively, of the circuit breaker base.

The first and second exterior walls may have a first thickness, and the first and second legs of the rigid magnetic member may have a second thickness, which is greater than the first thickness. The first and second interior walls may have a third thickness, which is less than the first thickness.

As another aspect of the invention, a circuit breaker comprises: a housing including a first opening and a second opening; at least one pair of separable contacts including a stationary contact and a movable contact disposed in the housing; an operating mechanism disposed in the housing and coupled to the separable contacts, the operating mechanism being structured to move the separable contacts between an open position and a closed position; a trip mechanism disposed in the housing and coupled to the operating mechanism, the trip mechanism being structured to actuate the operating mechanism to open the separable contacts; and a slot motor assembly disposed about the separable contacts, the slot motor assembly having an upper slot motor assembly and a lower slot motor assembly, the lower slot motor assembly being disposed below the stationary contact, the upper slot motor assembly being disposed above the movable contact, the upper slot motor assembly comprising a rigid magnetic member having a bight portion, a first leg, and a second leg, the first leg of the rigid magnetic member engaging the housing within the first opening, the second leg of the rigid magnetic member engaging the housing within the second opening.

The rigid magnetic member may comprise a plurality of laminated U-shaped steel plates resting in a U-shaped holder.

The housing may further include a plurality of first interior walls and a first exterior wall, which define the first opening, and a plurality of second interior walls and a second exterior wall, which define the second opening. The first and second legs of the rigid magnetic member may engage the first and second interior walls, in order to reinforce the first and second exterior walls, respectively.

The first and second interior walls of the housing in combination with the first and second legs may limit motion of the first and second exterior walls, respectively, of the housing during interruption of a power circuit when the separable contacts move from the closed position to the open position in response to the trip mechanism. The first and second interior walls of the housing in combination with the first and second legs may enable the first and second exterior walls, respectively, of the housing to withstand pressure within the housing during interruption of the power circuit.

The first and second legs may provide a continuous bridge between the first and second interior walls of the housing and the first and second exterior walls, respectively, of the housing.

The rigid magnetic member may be installed in the circuit breaker after assembly of the trip mechanism and the operating mechanism in the housing.

As another aspect of the invention, an electrical switching apparatus comprises: a housing including a first opening and a second opening; separable contacts including a first contact and a second contact disposed in the housing; an operating mechanism disposed in the housing and coupled to the separable contacts, the operating mechanism being structured to move the separable contacts between an open position and a closed position; a trip mechanism disposed in the housing and cooperating with the operating mechanism to trip open the separable contacts; and a slot motor assembly disposed about the separable contacts, the slot motor assembly having a first slot motor portion and a second slot motor portion, the first slot motor portion being disposed proximate the first contact, the second slot motor portion being disposed proximate the second contact, the first slot motor portion comprising a rigid magnetic member having a bight portion, a first leg, and a second leg, the first leg of the rigid magnetic member engaging the housing at the first opening, the second leg of the rigid magnetic member engaging the housing at the second opening.

The first and second openings may have four sides. The housing may further include three first interior walls and a first exterior wall, which define the four sides of the first opening, and three second interior walls and a second exterior wall, which define the four sides of the second opening. The first and second legs of the rigid magnetic member may include four sides, which engage the four sides of the first and second openings, in order to reinforce the first and second exterior walls, respectively.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
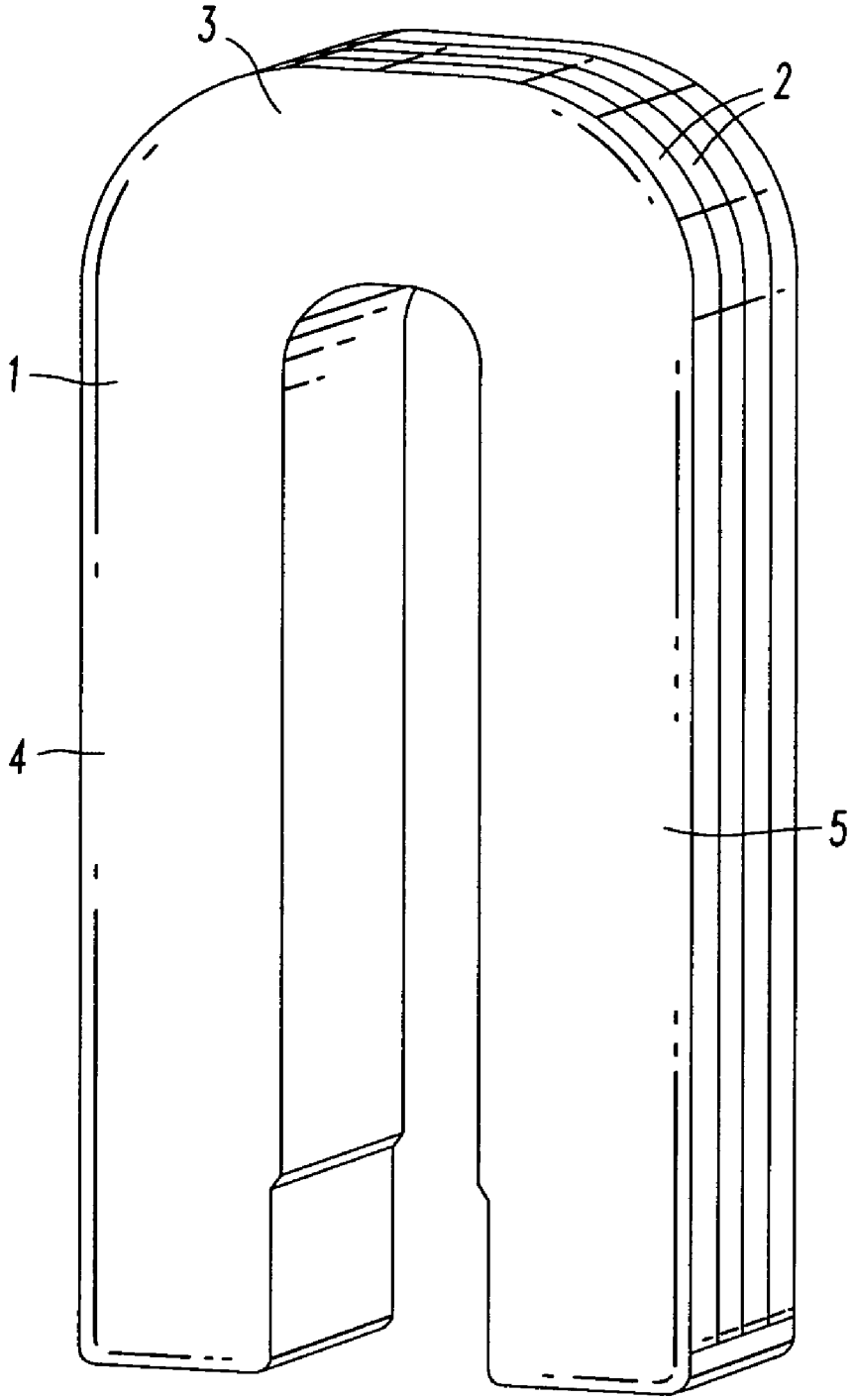
FIG. 1 PRIOR ART
FIG. 1 is an isometric view of an upper slot motor assembly.
Figure 2:
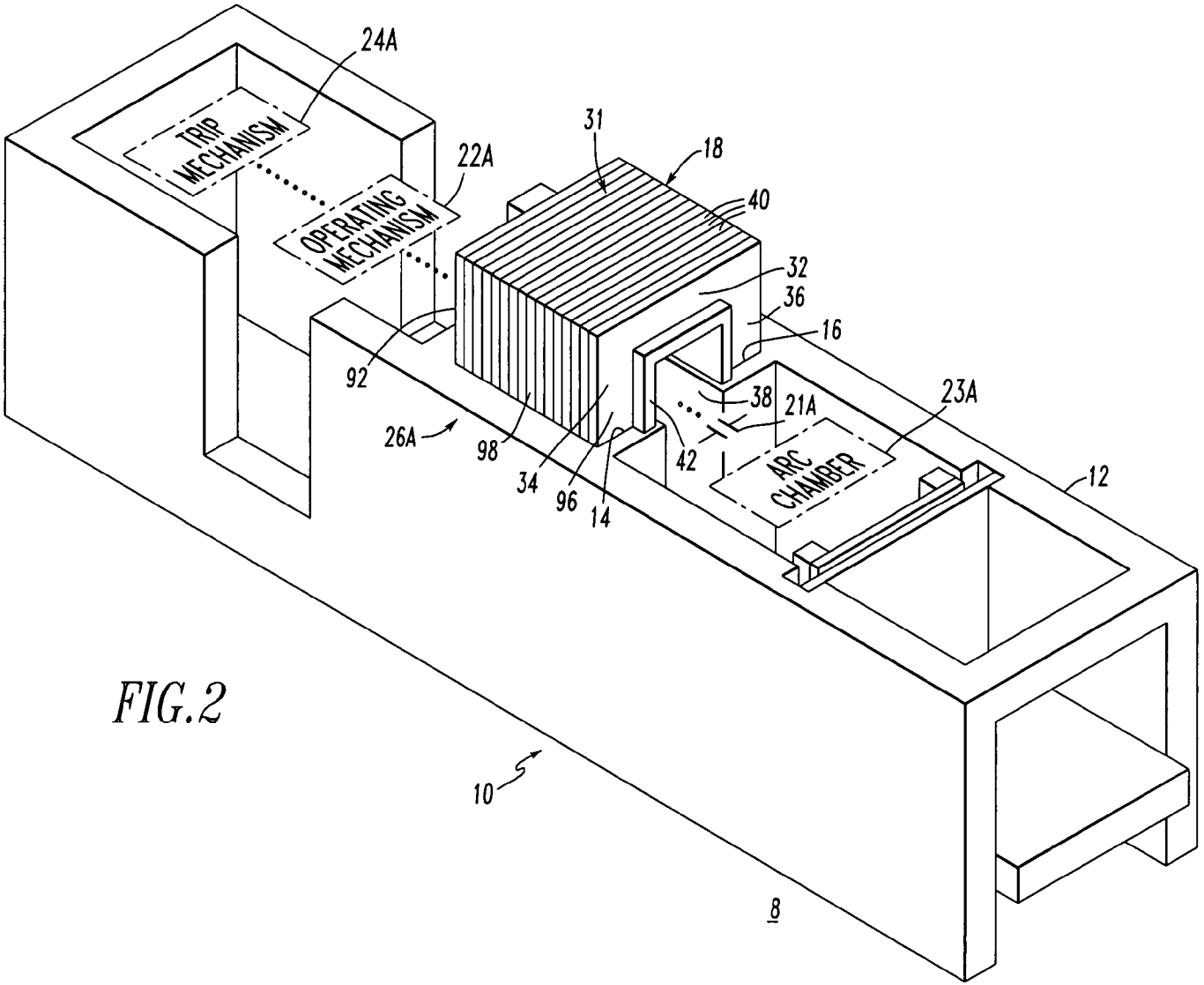
FIG. 2 is a simplified isometric view of a circuit breaker, with the cover removed for convenience of illustration, including a circuit breaker housing having a base with openings holding a rigid magnetic member in accordance with an embodiment of the present invention.

Referring to FIG. 2, a single pole circuit breaker 8 includes a molded housing 10 having a molded base 12 with first and second openings 14,16 molded therein for holding an upper slot motor assembly 18. Although a single pole circuit breaker 8 is shown, the invention is applicable to a wide range of electrical switching apparatus having a wide range of phase or pole counts.

Although a simplified view of the circuit breaker 8 is shown in FIG. 2, it will be appreciated that this circuit breaker 8 includes a cover (not shown), separable contacts 21A, an operating mechanism 22A, an arc chamber 23A, a trip mechanism 24A, and a slot motor assembly 26A disposed about such separable contacts. For example, the three-pole circuit breaker 19 of FIG. 8 includes a cover 20, separable contacts 21, an operating mechanism 22 coupled to the separable contacts 21 and structured to move such contacts between an open position (not shown) and a closed position, a trip mechanism 24 structured to actuate the operating mechanism 22 to trip open the separable contacts 21, a slot motor assembly 26 disposed about the separable contacts 21, and a base 28. The slot motor assembly 26 includes an upper slot motor assembly 156A and a lower slot motor assembly 156B. As will be explained, below, this circuit breaker 19, similar to the circuit breaker 8 of FIG. 2, incorporates the slot motor assembly 26 within the circuit breaker base 28.

Referring to FIGS. 2–5, the upper slot motor assembly 18 is a rigid magnetic member 31 having a general U-shape (e.g., made from a plurality of laminations stacked together; made from a solid machined or cast piece), with a bight portion 32, a first leg 34, a second leg 36, and a gap 38 between the first and second legs 34,36. The first leg 34 engages the base 12 at the first opening 14 and the second leg 36 engages the base 12 at the second opening 16. In this example, the member 31 includes a plurality of laminated U-shaped plates 40 (e.g., steel; a suitable iron based alloy; a suitable ferrous material) resting in a U-shaped holder 42 (e.g., made of a suitable thermoset plastic material). The U-shaped holder 42 engages the base 12 proximate the first and second openings 14,16. The magnetic member 31 is preferably installed in the circuit breaker housing 10 after assembly of the trip mechanism 24A and the operating mechanism 22A in the housing 10.

Figure 3:
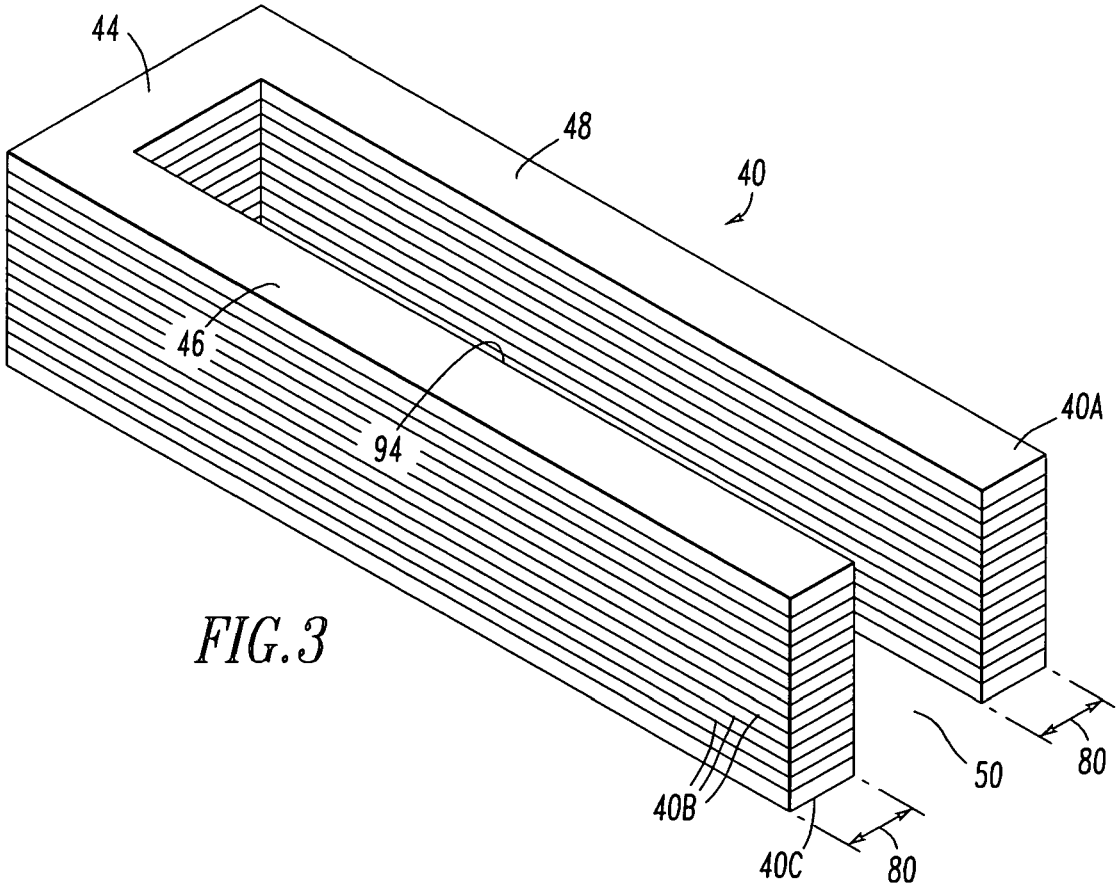
FIG. 3 is an isometric view of the slot motor laminated plates of FIG. 2.

As shown in FIG. 3, each of the laminated U-shaped plates 40 includes a bight portion 44, a pair of legs 46,48, and a gap 50 between the pair of legs 46,48. The U-shaped holder 42 of FIG. 4 includes a bight portion 52 engaging the bight portion 44 of each of the laminated U-shaped plates 40 and a pair of legs 54,56 engaging the pair of legs 46,48, respectively, of each of the laminated U-shaped plates 40.

Figure 4:
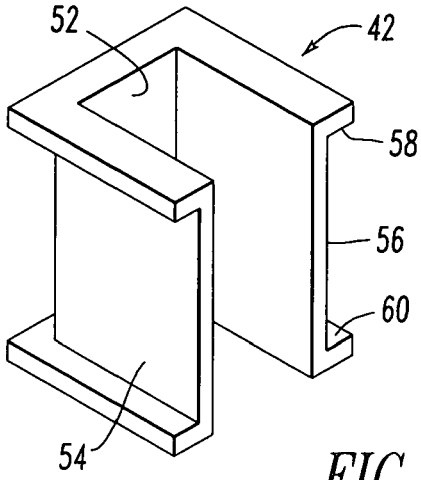
FIG. 4 is an isometric view of the U-shaped holder of FIG. 2.

Continuing to refer to FIGS. 3 and 4, the laminated U-shaped plates 40 include a first laminated U-shaped plate 40A, a plurality of second or central laminated U-shaped plates 40B and a third laminated U-shaped plate 40C. The U-shaped holder 42 further includes a first U-shaped edge 58 engaging the first laminated U-shaped plate 40A and a second U-shaped edge 60 engaging the third laminated U-shaped plate 40C. The second laminated U-shaped plates 40B are laminated between the first and third laminated U-shaped plates 40A,40C. Preferably, a sufficient count of the plates 40A,40B,40C is employed such that the combination of these plates is compressively held between the U-shaped edges 58,60. Preferably, a suitable minimal clearance is provided between the legs 54,56 and the respective openings 14,16, in order to minimize flexing of the housing base 12. The laminated U-shaped steel plates 40A,40B,40C and the U-shaped holder 42 form the magnetic member 31 of FIG. 2.

Figure 5:
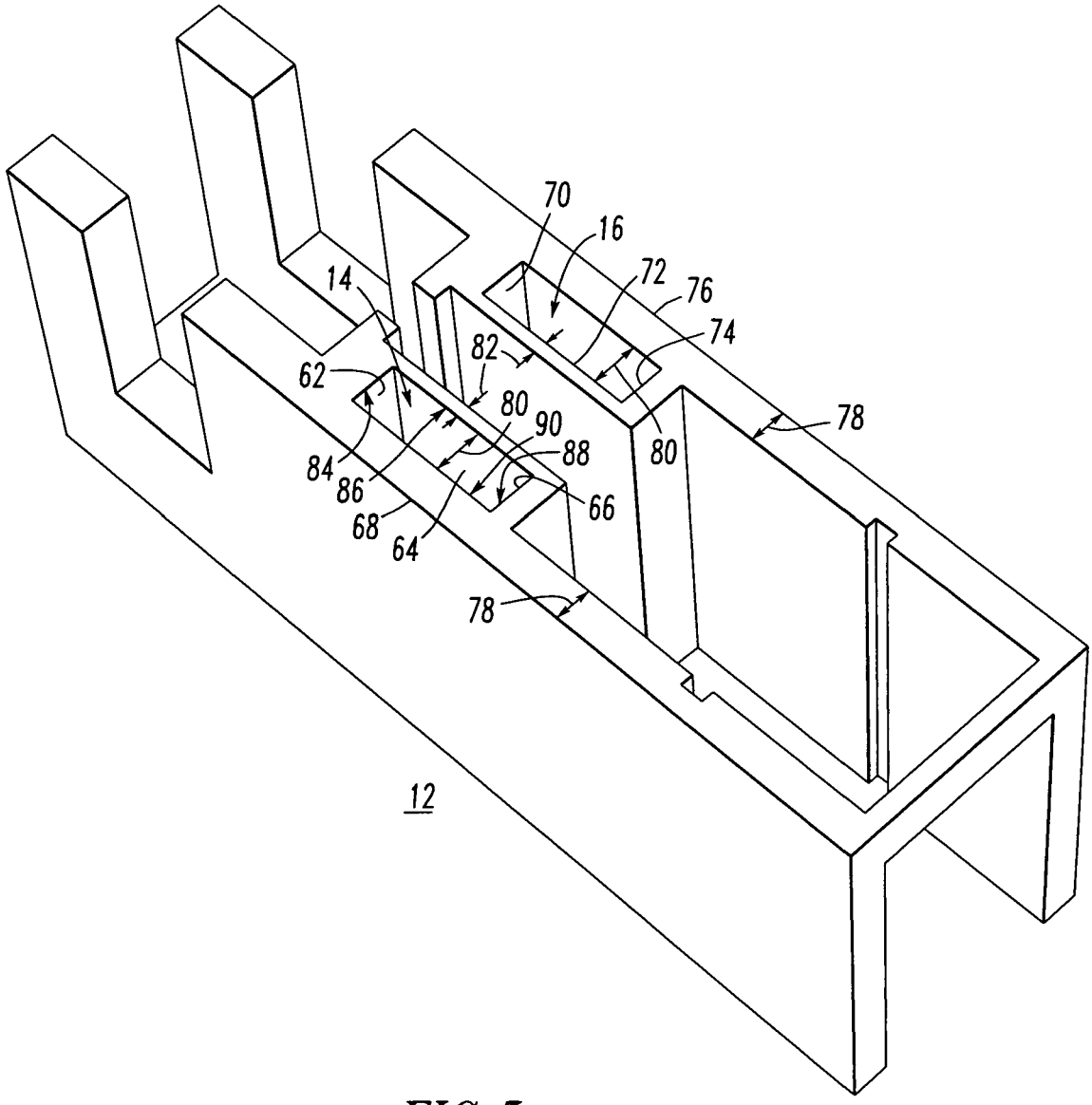
FIG. 5 is an isometric view of the circuit breaker base of FIG. 2.

The housing base 12 of FIG. 5 includes a plurality of first interior walls 62',64,66 and a first exterior wall 68, which define the first opening 14, and a plurality of second interior walls 70,72,74 and a second exterior wall 76, which define the second opening 16. The first leg 34 and the second leg 36 of the magnetic member 31 of FIG. 2 engage the first interior walls 62,64,66 and the second interior walls 70,72,74, in order to reinforce and add rigidity to the first exterior wall 68 and the second exterior wall 76, respectively.

The first and second exterior walls 68,76 have a first thickness 78. The first and second legs 34,36 of the magnetic member 31 (and the openings 14,16) have a second thickness 80 (shown in FIGS. 3 and 5), which is greater than the first thickness 78. The first interior walls 62,64,66 and the second interior walls 70,72,74 in combination with the first leg 34 and the second leg 36 limit motion of the first exterior wall 68 and the second exterior wall 76, respectively, during interruption of a power circuit (not shown) (e.g., when the separable contacts 21A of FIG. 2 move from the closed position to the open position in response to the trip mechanism 24A). This combination also enables the exterior walls 68,76 to withstand the build-up of relatively extreme pressure within the housing 10 of FIG. 2 during interruption of the corresponding power circuit (not shown). Preferably, the first and second legs 34,36 provide a continuous bridge between the first and second interior walls 62,64,66 and 70,72,74 and the first and second exterior walls 68 and 76, respectively. A third thickness 82 of the interior walls, such as 64,72, is smaller than the first exterior wall thickness 78. The combination of the interior walls 62,64,66 and 70,72,74 with the steel laminations of the legs 34 and 36 of FIG. 2, limits the motion of the base exterior walls 68 and 76, respectively, during relatively extreme pressure "build-up" encountered during interruption, which prevents the fracturing of such exterior walls.

EXAMPLE 1

Non-limiting examples of the thicknesses 78, 80 and 82 are 0.200", 0.250" and 0.060" (minimum), respectively.

EXAMPLE 2

Alternatively, the second thickness 80 of the magnetic member legs may be less than the first thickness 78 of the exterior walls.

Each of the first and second openings 14,16 of FIG. 5 has four sides 84,86,88,90. For example, the three first interior walls 62,64,66 and the interior surface of the first exterior wall 68 define the four sides of the first opening 14. Similarly, the three second interior walls 70,72,74 and the interior surface of the second exterior wall 76 define the four sides of the second opening 16. The first and second legs 34,36 of the magnetic member 31 of FIG. 2 include four sides 92,94,96,98 (generally shown in FIG. 2, with side 94 shown in FIG. 3), which engage the four sides 84,86,88,90 of the first and second openings 14,16 (as shown with the opening 14 of FIG. 5), in order to reinforce and add rigidity to the first and second exterior walls 68,76, respectively.

Figure 6:
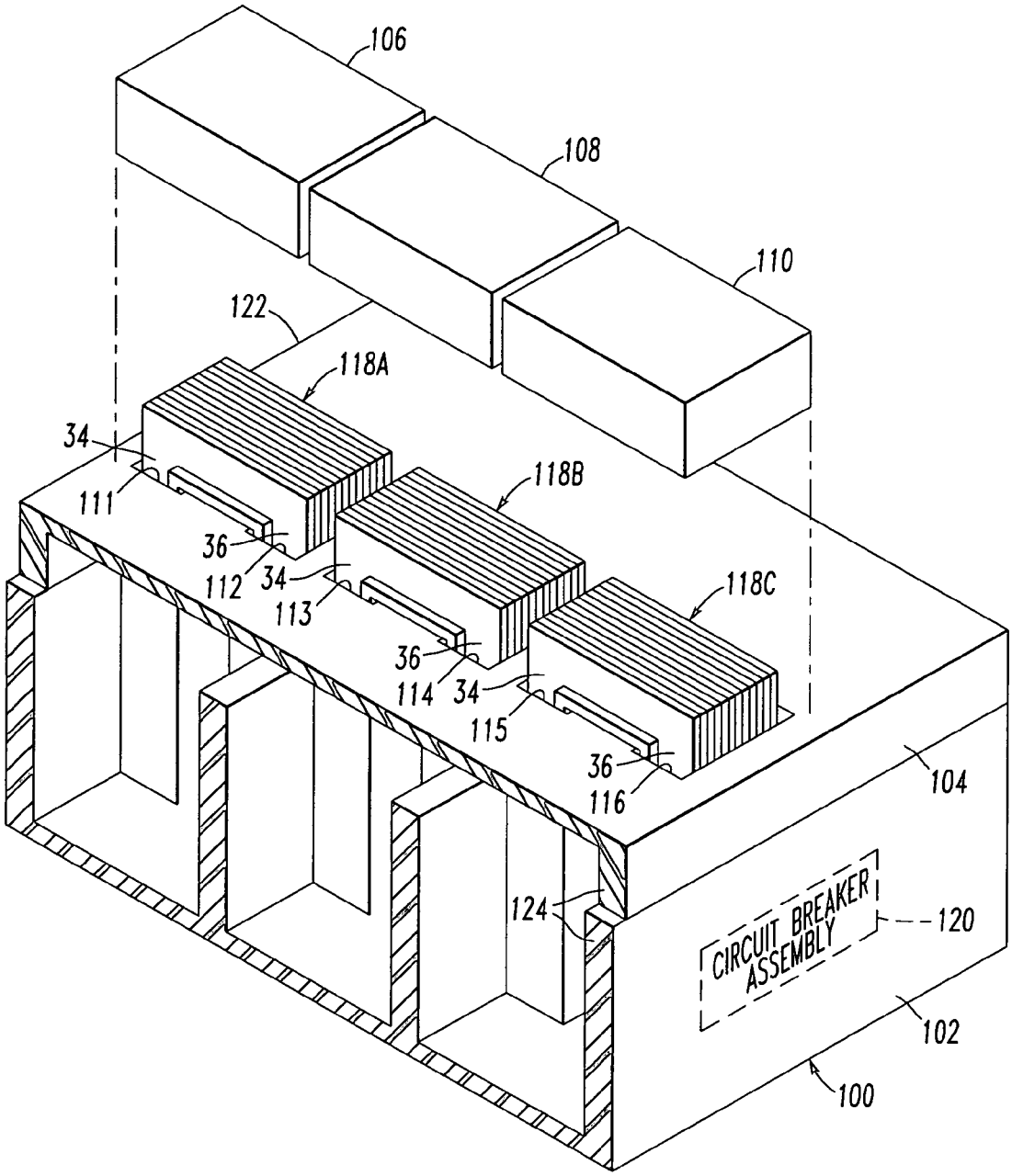
FIG. 6 is a partially exploded, simplified isometric view of part of a three-phase circuit breaker housing including a base and a cover, with three cover portions exploded for convenience of illustration, in which both the base and the cover have openings for holding rigid magnetic members in accordance with another embodiment of the invention.

Referring to FIG. 6, a three-phase circuit breaker molded housing 100 includes a molded base 102 and a molded cover 104 having three cover portions 106,108,110 (shown exploded for convenience of illustration). Here, both the base 102 and the cover 104 have six openings 111,112,113, 114,115,116 (as shown only with the cover 104) molded therein for holding three rigid magnetic members 118A, 118B, 118C (e.g., three of the rigid magnetic members 31 of FIG. 2). For example, the legs 34,36 of the rigid magnetic member 118A engage the molded cover 104 at the openings 111,112, respectively. The legs 34,36 of the rigid magnetic member 118B engage the molded cover 104 at the openings 113,114, and the legs 34,36 of the rigid magnetic member 118C engage the molded cover 104 at the openings 115,116, respectively.

Again, the rigid magnetic members 118A, 118B, 118C are installed after assembly of circuit breaker assembly 120 (as shown in block form in hidden line drawing) (including, e.g., separable contacts, operating mechanism, trip mechanism, lower slot motor assembly, arc chamber) is complete. This adds rigidity to the entire circuit breaker molded housing 100 (e.g., the base 102 and the cover 104) and enables the exterior case walls 122,124 to withstand relatively greater pressure forces. Another advantage of this embodiment is that it is possible to readily change from a standard performance circuit breaker (e.g., without a slot motor) to a relatively high performance circuit breaker (e.g., with a slot motor), thereby, eliminating different manufacturing styles.

Figure 7:
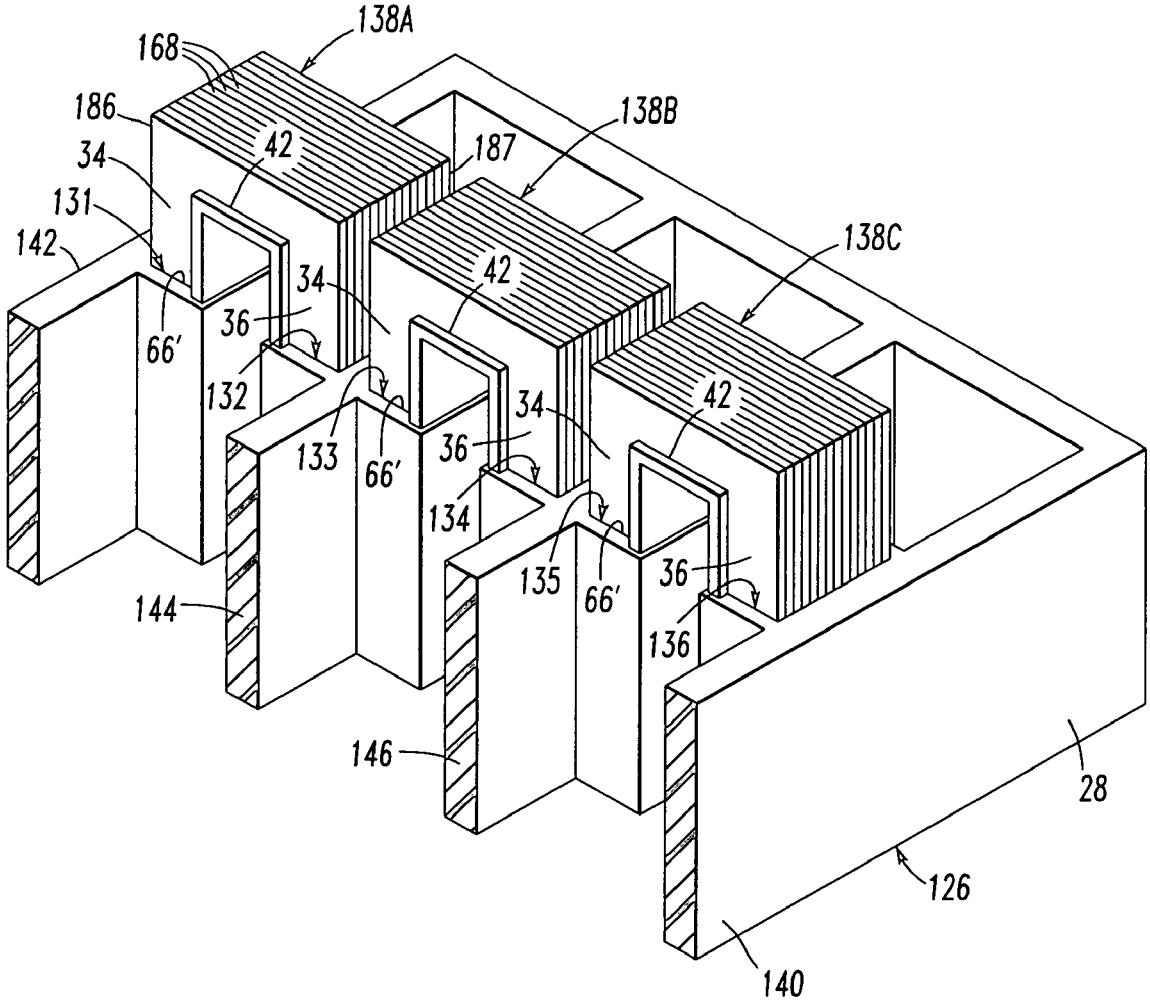
FIG. 7 is an isometric view of a three-phase circuit breaker housing, with the cover removed for convenience of illustration, including a base having openings for holding rigid magnetic members in accordance with another embodiment of the invention.

FIG. 7 shows another three-phase circuit breaker molded housing 126, with the molded cover (not shown) removed for convenience of illustration. This housing 126 includes the molded base 28, which is similar to the molded base 102 of FIG. 6, having six openings 131,132,133,134,135,136 for holding three rigid magnetic members 138A,138B,138C (e.g., three of the rigid magnetic members 31 of FIG. 2). For example, the legs 34,36 of the rigid magnetic member 138A engage the molded base 28 at the openings 131,132, respectively. The legs 34,36 of the rigid magnetic member 138B engage the molded base 28 at the openings 133,134, and the legs 34,36 of the rigid magnetic member 138C engage the molded base 28 at the openings 135,136, respectively. Although the members 138A,138C add rigidity to the exterior walls 140,142, the members 138A,138B,138C also add rigidity to the interior walls 144,146.

Figure 8:
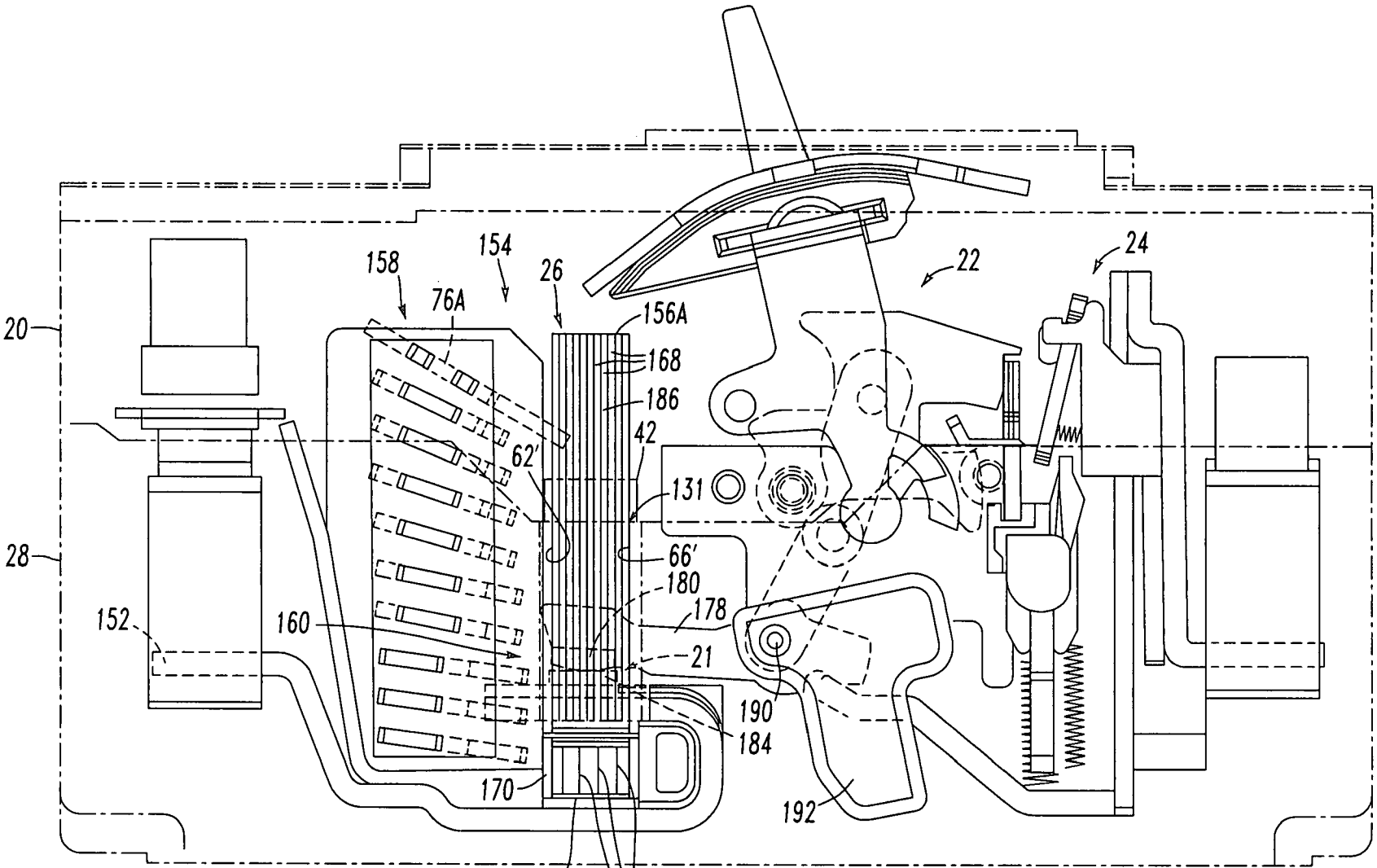
FIG. 8 is a longitudinal section of a side elevational view, partially broken away and partially in phantom, of an internal portion of the circuit breaker of FIG. 7.

Referring now to FIG. 8, the circuit breaker 19 includes a load terminal 150 and a line terminal 152. There is shown a plasma arc acceleration chamber 154 comprising the slot motor assembly 26 and an arc extinguisher assembly 158.

Also shown is a contact assembly 160, the operating mechanism 22, and the trip mechanism 24. Although not viewable in FIG. 8, each phase of the three-phase circuit breaker 19 has its own load terminal 150, line terminal 152, plasma arc acceleration chamber 154, slot motor assembly 26, arc extinguisher assembly 158, and contact assembly 160.

Each slot motor assembly 26 includes a separate first or upper slot motor portion or assembly 156A, which is disposed proximate or above the first or movable contact 180, and a second or lower slot motor portion or assembly 156B, which is disposed proximate or below the second or fixed contact 184. The upper slot motor assembly 156A includes a plurality of plates 168 and is structurally and functionally similar to the magnetic member 31 of FIG. 2. Similar to that magnetic member, the first and second legs 186,187 (only leg 186 is shown in FIG. 8) of the upper slot motor assembly 156A engage the base 28 at or within two corresponding openings 131,132 (only opening 131 with interior walls 62' and 66' is shown in FIG. 8).

The lower slot motor assembly 156B includes a lower slot motor assembly housing 170 within which are stacked side-by-side lower slot motor assembly plates 172 composed of magnetic material. The lower slot motor assembly 156B is structurally and functionally similar to that described in U.S. Pat. Nos. 5,910,760 and 6,452,470, which are incorporated herein by reference.

The plates 168 and 172 form an essentially closed electromagnetic path in the vicinity of movable contact 180 and stationary contact 184. At the beginning of a contact opening operation, electrical current continues to flow in a movable contact arm 178 and through an electrical arc created between contacts 180 and 184. This current induces a magnetic field into the closed magnetic loop provided by upper plates 168 and lower plates 172 of upper slot motor assembly 156A and lower slot motor assembly 156B, respectively. This magnetic field electromagnetically interacts with the current in such a manner as to accelerate the movement of the movable contact arm 178 in the opening direction whereby contacts 180 and 184 are more rapidly separated. The higher the magnitude of the electrical current flowing in the arc, the stronger the magnetic interaction and the more quickly contacts 180 and 184 separate.

For very high current (e.g., an overcurrent condition), the above process provides a blow-open operation in which the movable contact arm 178 forcefully rotates upwardly about pivot pin 190 and separates contacts 180 and 184, this rotation being independent of crossbar assembly 192. This blow-open operation is shown and described in U.S. Pat. No. 3,815,059, which is incorporated herein by reference, and provides a faster separation of contacts 180 and 184 than can normally occur as the result of a tripping operation generated by the trip mechanism 24.

Although generally rectangular openings 14,16 and legs 34,36 are disclosed, a wide range of cross-sectional shapes (e.g., three sided; rounded; circular; square; five or more sided) may be employed.

Although the rigid member 31 has a general U-shape, a wide range of shapes and sizes may be employed. For example, the U-shape may have square or rounded corners. Although the legs 34,36 are preferably parallel, those may be angled outward or inward to the extent that the openings 14,16 are suitably modified to receive the legs.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. An upper slot motor assembly for a circuit breaker slot motor assembly, said upper slot motor assembly comprising:

a circuit breaker housing including a circuit breaker base having a first opening and a second opening;

a rigid magnetic member having a bight portion, a first leg, and a second leg, the first leg of said rigid magnetic member engaging the circuit breaker base of said circuit breaker housing at said first opening, the second leg of said rigid magnetic member engaging the circuit breaker base of said circuit breaker housing at said second opening; and wherein the circuit breaker base of said circuit breaker housing includes a plurality of first interior walls and a first exterior wall, which define the first opening of said circuit breaker base, and a plurality of second interior walls and a second exterior wall, which define the second opening of said circuit breaker base; and wherein the first and second legs of said rigid magnetic member engage said first and second interior walls, in order to reinforce the first and second exterior walls, respectively, of said circuit breaker base.

2. The upper slot motor assembly of claim 1 wherein the first and second exterior walls have a first thickness; and wherein the first and second legs of said rigid magnetic member have a second thickness, which is greater than said first thickness.

3. The upper slot motor assembly of claim 2 wherein the first and second interior walls have a third thickness, which is less than said first thickness.

4. A circuit breaker comprising:

a housing including a first opening and a second opening;

at least one pair of separable contacts including a stationary contact and a movable contact disposed in said housing;

an operating mechanism disposed in said housing and coupled to said separable contacts, said operating mechanism being structured to move said separable contacts between an open position and a closed position;

a trip mechanism disposed in said housing and coupled to said operating mechanism, said trip mechanism being structured to actuate said operating mechanism to open said separable contacts;

a slot motor assembly disposed about said separable contacts, said slot motor assembly having an upper slot motor assembly and a lower slot motor assembly, said lower slot motor assembly being disposed below said stationary contact, said upper slot motor assembly being disposed above said movable contact, said upper slot motor assembly comprising a rigid magnetic member having a bight portion, a first leg, and a second leg, the first leg of said rigid magnetic member engaging said housing within said first opening, the second leg of said rigid magnetic member engaging said housing within said second opening; and wherein said housing further includes a plurality of first interior walls and a first exterior wall, which define the first opening, and a plurality of second interior walls and a second exterior wall, which define the second opening; and wherein the first and second legs of said rigid magnetic member engage said first and second interior walls, in order to reinforce the first and second exterior walls, respectively.

5. The circuit breaker of claim 4 wherein the first and second interior walls of said housing in combination with said first and second legs limit motion of the first and second exterior walls, respectively, of said housing during interruption of a power circuit when said separable contacts move from the closed position to the open position in response to said trip mechanism.

6. The circuit breaker of claim 5 wherein the first and second interior walls of said housing in combination with said first and second legs enable the first and second exterior walls, respectively, of said housing to withstand pressure within said housing during interruption of said power circuit.

7. The circuit breaker of claim 5 wherein said first and second legs provide a continuous bridge between the first and second interior walls of said housing and the first and second exterior walls, respectively, of said housing.

8. The circuit breaker of claim 4 wherein the first and second exterior walls have a first thickness; and wherein the first and second legs of said rigid magnetic member have a second thickness, which is greater than said first thickness.

* * * * *